US005267120A

United States Patent [19]

Graff et al.

[11] Patent Number: 5,267,120

[45] Date of Patent: Nov. 30, 1993

[54] RELAY CONTROL APPARATUS

[75] Inventors: Timothy Graff, Palatine; Gregory A. Peterson, South Barryington, both of Ill.

[73] Assignee: Digital Appliance Controls, Inc., Hoffman Estates, Ill.

[21] Appl. No.: 46,139

[22] Filed: May 4, 1987

[51] Int. Cl.[5] ..... H01F 7/18

[52] U.S. Cl. ..... 361/185; 323/244; 361/195

[58] Field of Search ..... 323/235, 244, 319; 361/143, 152, 160, 170, 185, 195-198, 203

[56] References Cited

U.S. PATENT DOCUMENTS

| | | | |
|---|---|---|---|
| 3,390,275 | 6/1968 | Baker | 307/64 |
| 3,600,657 | 8/1971 | Pfaff | 323/244 |
| 3,965,398 | 6/1976 | Miller | 361/198 |
| 4,090,228 | 5/1978 | Lupatin | 307/130 |
| 4,153,922 | 5/1979 | Azuma et al. | 361/185 |
| 4,204,149 | 5/1980 | Cleary et al. | 315/360 |
| 4,218,648 | 8/1980 | Sansum | 323/235 |
| 4,245,184 | 1/1981 | Billings et al. | 323/235 |
| 4,317,056 | 2/1982 | Alberts | 307/130 |
| 4,336,464 | 6/1982 | Weber | 315/360 |
| 4,338,562 | 7/1982 | Terwilliger | 323/323 |
| 4,357,545 | 11/1982 | Le Grand et al. | 307/64 |
| 4,420,694 | 12/1983 | Yokota et al. | 307/130 |
| 4,745,515 | 5/1988 | Fowler | 361/185 |

*Primary Examiner*—William H. Beha, Jr.
*Attorney, Agent, or Firm*—Buchanan Ingersoll

[57] ABSTRACT

The operation of an electromechanical relay is synchronized with the power line waveform where an electrical power supply is supplied from a source to an electrical load. The current voltage supplied to the load is characterized by a power line waveform. An electromechanical relay is positioned between the power supply and the load where contacts of the relay are opened and closed to interrupt and supply power to the load. A microcontroller is positioned between a power source and the electromechanical relay and actuates the relay so that when the contacts are closed or opened the contacts are not exposed to an undesired voltage. A feedback control circuit senses the opening and closure of the contacts so that in the event the contacts, for example close at an undesireable point on the load current waveform the microcontroller adjusts for the necessary delay to cause the actuation of the relay to occur such that the contact closure is at the desired point in the load current waveform.

3 Claims, 6 Drawing Sheets

RELAY CONTROL APPARATUS

BACKGROUND OF THE INVENTION

1. Field of the Invention

This invention relates to method and apparatus for controlling the operation of an electromechanical relay and more particularly to circuitry for operating an electromechanical relay to supply or remove power from a load at a preselected interval in the A.C. waveform.

2. Description of the Prior Art

In the operation of electrical household appliances, such as microwave ovens, dishwashers, and the like, electromechanical relays are utilized to connect and disconnect the load to a power source. The relays must be turned on and off at specific intervals to control the various appliance functions. It is known in the operation of microwave ovens to utilize a triac to control the flow of power from the source to the magnetron transformer. Unlike a relay, the turn on time of a triac is negligible, and little or no compensation is required in the timing of actuation of the triac to provide power to the magnetron at a specific point in the A.C. voltage waveform.

The utilization of a triac requires the incorporation of a heat sink and an optocoupler which substantially increases the cost of the solid state control circuitry. However, the utilization of a triac is preferred over a conventional electromechanical relay because of timing differences between relays and of changes which occur in the timing of the open and closure of relay contacts over the life of the relay.

If the operation of the relay is not synchronized to the voltage waveform, then the relay contacts will open or close at random points in the power line waveform If the relay is operated to open the contacts to break the load current and sufficient line voltage potential is present, a high temperature electrical arc forms between the relay contacts. Arcing causes contact erosion where the contact is destroyed, reducing the service life of the relay.

The synchronization of the relay operation with the waveform is dependent o the time interval required for closure of the relay, known as the pull in time. Due to timing variations between relays and over the life of a relay, it is not uncommon for contact breaking or closure to occur at other than the desired points on the power line waveform. For example, actuation may occur other than at the waveform crest in the switching of the magnetron transformer of a microwave oven. Consequently, when the relay contacts do not close at the desired point, such as other than the waveform crest, large current transients for an inductive load may exceed 120 amps. Voltage transients can result in arc destruction of the contacts.

In the case of a microwave oven control when the relay operation is not synchronized on the power line waveform, current transients occur, resulting in transformer vibration which customarily is recognized by an audible noise. It is the conventional practice to utilize noise suppression devices to eliminate this problem. Such devices add additional cost and complexity to the appliance control apparatus.

Initially electromechanical relays can be synchronized with the power line waveform to open and close at intervals which prevent arcing or a spark occurring between separating contacts. The synchronization is lost as the relay contacts wear and the spring bias weakens, resulting in electrical arcing between separating contacts. An electrical arc causes contact material to be eroded from one contact and deposited on the mating contact. The direction of material erosion is determined by the voltage polarity of the spark. The eroded material takes the form of small cone shaped peaks on the contacts, and eventually the contacts where the contacts may eventually stick or weld together.

Electrical arcing across relay contacts generates heat. The contact material will melt then boil as the heat becomes excessive. Material will be transferred from one contact to another during successive switching operations. Also, splattering of molten metal occurs as contacts bounce, diminishing the area of contact.

In A.C. switching the relay contacts break load current at the same approximate point on the sine wave. The same contact is always positive and the other negative at the instant of contact separation. Material is transferred from the cathode to the anode. The amount of material transferred is dependent on the severity and duration of the arc and the type of contact material used. Thus over the cycle life of a relay contact material loss can be substantial and prevent effective operation of the appliance.

One known technique for arc suppression is the positioning of a capacitor in parallel with the contacts to prevent an arc from striking as the contacts open. As the contacts open the capacitance shunts the voltage away from the contacts; however, when the contacts close again, capacitor charge is dumped on the contacts causing an arc to strike. Therefore, to prevent charge dumping a small resistance is placed in series with the capacitor. The resistance limits capacitor current but it also reduces the effectiveness of the capacitor.

In an inductive-load application it is known to use for arc suppression a clamping device, such as a varistor, in parallel with the contacts or load. In this case, when the counter electromotive force exceeds the voltage rating of the clamp, the clamp switches from a very high to very low resistance, allowing current to flow through it. If the clamping device is to be used in A.C. applications the clamp voltage must in excess of the peak of the highest possible expected rms voltage.

The known methods of arc suppression do not allow adjustments to be made in the operation of the electromechanical relay throughout the contact life. While contact arc suppression is known, there is further need to control the operation of a relay to extend the relay service life. By controlling the point at which the contacts break a load current, the life of the contacts can be significantly extended.

SUMMARY OF THE INVENTION

In accordance with the present invention there is provided apparatus for synchronizing the operation of an electromechanical relay with a current waveform of a power line that includes an electrical power supply, which is characterized by a waveform of the current through the power line. An electrical load receives current from the power line. A relay is positioned in series with the power line and the load. The relay includes a pair of contacts being moveable upon actuation between an open position and a closed position to interrupt and supply power to the load. Control means controls the point on the power line waveform when the relay is selectively actuated to open and close the contacts to the load. The control means is connected between the power supply and the relay. Feedback control means is connected to the contacts and the control means for detecting the actuation of the relay. The feedback control means receives an input signal from the contacts upon opening and closing and supplies a responsive output signal to the control means. The control means is adjustable to provide a time delay for closure and opening of the contacts so that power is interrupted and supplied to the load at a preselected point in the power line waveform.

Accordingly the principal object of the present invention is to provide circuitry for accurately controlling the actuation of an electromechanical relay to open and close at a preselected time in the power line waveform.

Another object of the present invention is to provide apparatus for supplying and removing electrical power to and from an electromechanical relay so that the contacts of the relay close or open at a predetermined point in the power line waveform with respect to a set reference point in the waveform.

A further object of the present invention is to provide a control system for an electromechanical relay that adapts to changes in the closure and opening of relay contacts to maintain operation of the relay at a predetermined point over the service life of the relay.

An additional object of the present invention is to provide method and apparatus for minimizing the transfer of material between the contacts of a relay when a relay interrupts the flow of A.C. current between the power supply and a load.

These and other objects of the present invention will be more completely disclosed and described in the following specification, the accompanying drawings, and the appended claims.

DESCRIPTION OF THE PREFERRED EMBODIMENTS

Figure 1:
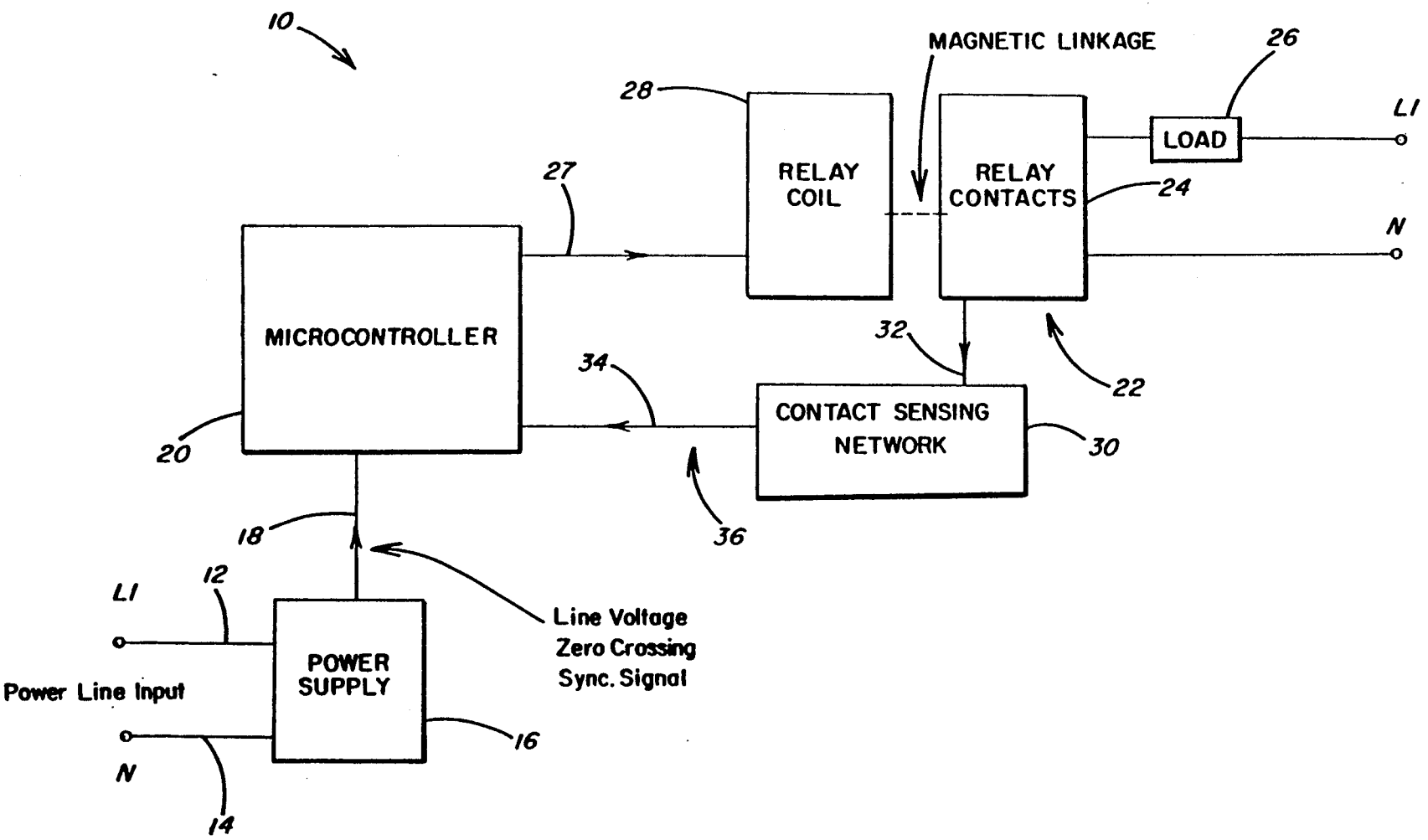
FIG. 1 is a diagrammatic illustration of a synchronized circuit for adjusting the opening and closing of relay contacts to maintain contact operation synchronized with the power line waveform.

Referring to the drawings and particularly to FIG. 1, there is diagrammatically illustrated a synchronization circuit generally designated by the numeral 10 for supplying power through power input lines 12 and 14 to a power source of an electrical apparatus, such as a transformer on a microwave oven. A power supply 16 generates an A.C. power line synchronization signal to a microcontroller 20 by which contacts 24 of an electromechanical relay 22 are opened and closed at a predetermined setpoint in the A.C waveform. The A.C. voltage waveform is a conventional sine wave. The relay contacts 24 are switched on and off to thereby connect the A.C. line voltage to a load 26, such as the magnetron of a microwave oven. The microcontroller 20 supplies an input signal through conductor 27 to actuate a coil 28 to close the normally open contacts 24 of relay 22.

The electromechanical relay 22 includes contacts 24 which are controlled by applying power to or removing power from the relay coil 28 so that the contacts 24 open or close at a predetermined point with respect to a set reference point on the power line waveform. Opening and closing of the relay contacts 24 is monitored by a relay sensor 30 connected by conductor 32 to the relay contacts 24. The relay sensor 30 receives input from the contacts 24 and generates a corresponding output signal through conductor 34 as input to the microcontroller 20 in a closed feedback loop generally designated by the numeral 36.

Over the service life of the electromechanical relay 22 the period of time for effecting opening or closure of the contacts 24 will vary. Consequently the contacts 24 will not close or open at the same point in the power line waveform throughout the service life of the relay. Timing adjustments must be made to insure that the operation of the relay 22 remains synchronized with the desired setpoint, for example the voltage zero crosspoint, in the voltage waveform. The microcontroller 20 compensates for variations in the operation of the relay 22 to maintain synchronization of the relay contacts 24 to the predetermined setpoint. The microcontroller 20 monitors the relay sensor 30 to measure the timing of relay 22 and generates a signal to the relay coil 28 to maintain the contacts 24 closed or opened at the specified point on the power line waveform.

The synchronization circuit 10 adapts to changes in the "pull-in" or "drop-out" timing of the relay 22 to maintain the desired synchronization of the contacts 24 with the voltage waveform over the service life of the electromechanical relay 22. The present invention also has application in adjusting the synchronization of electromechanical relays that are mass produced to assure that each relay "pulls-in" or "drops-out" at a set reference point in the power line.

In one example of the present invention, the relay contacts 24 are required to close near the crest of the line voltage waveform. In that instance a signal is generated through conductor 32 to the relay sensor 30 which in turns transmits an input signal via conductor 34 to the microcontroller 20. Thus the microcontroller 20 detects the occurrence of contact closure. Each time the microcontroller 20 generates a signal for closing the relay contacts 24, the elapsed time for contact closure is measured. The microcontroller 20 detects the occurrence of a line voltage zero crossing via conductor 18. The microcontroller 20 can then detect the line voltage zero crossing and detect the pull-in time of the relay contacts 24.

If the relationship between line voltage zero crossing and line voltage crest is known, then the microcontroller 20 determines the time delay necessary following line voltage zero crossing prior to energizing the relay coil 28. In this manner contact closure is effected at the line voltage crest. The delay time equals the zero crossing to crest time minus the measured relay pull-in time.

The microcontroller 20 adapts to changes in the relay timing over the service life of the relay 22, and also from relay to relay time variations in mass production.

With the present invention the microcontroller 20 via the closed feedback loop 36 through conductor 34 and relay sensor 30 measures the pull in time of the relay 22 each time the relay 22 is actuated. The microcontroller 20 measures the pull-in time of the relay 22 by determining the length of time between actuation of the relay coil 28 and the corresponding output signal generated through the conductor 32 to the relay sensor 30. In this manner the microcontroller 20 provides necessary delay to cause the relay contacts 24 to close at the desired point in the line voltage waveform with respect to the line voltage zero crossing point. By accurately controlling the operation of the relay 22 through the closed feedback loop 36, the service life of the relay 22 is substantially enhanced.

Figure 2:
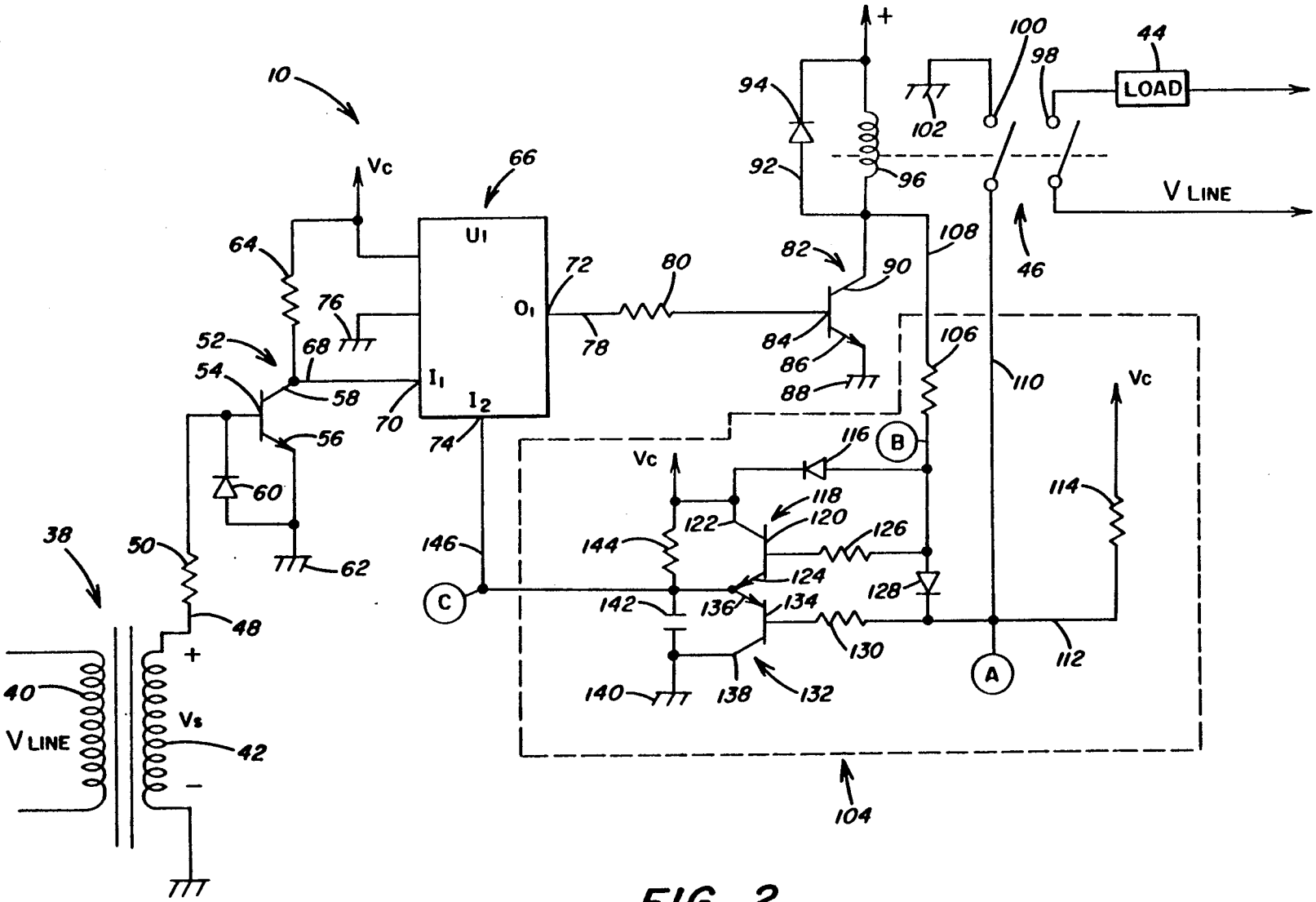
FIG. 2 is a schematic illustration of one circuit corresponding to the arrangement shown in FIG. 1 for controlling the operation of an electromechanical relay connecting power to a load.

Now referring to FIG. 2, there is illustrated in greater detail the synchronization circuit diagrammatically illustrated in FIG. 1 and discussed above in which a stepdown transformer generally designated by the numeral 38 supplies power from a main power line to a primary coil 40 of the transformer 38. The main power line is the same power line that supplies power to a load 44 to be controlled by an electromechanical relay generally designated by the numeral 46 or has a known phase relationship to the power line connected to the controlled load 44. Due to the operational characteristics of a transformer such as transformer 38, the voltage present at secondary coil 42 is proportional in amplitude and has a fixed phase relationship to the voltage waveform applied to the primary coil 40.

The transformer coil 42 is connected by conductor 48 through resistor 50 to a transistor generally designated by the numeral 52 having a base 54, emitter 56 and a collector 58. With this arrangement when voltage Vs applied to the transistor base 54 is more negative than the actuation voltage of transistor 52, transistor 52 is maintained in a nonconductive state. A clamping diode 60 is connected across transistor base 54 and ground 62 and is forward biased. Current then flows through resistor 50 in a negative direction, and transistor 52 remains nonconductive.

With transistor 52 in a nonconductive state the voltage at collector 58 is near supply voltage $V_c$. As $V_s$ from the transformer coil 42 increases to a level greater than the turn-on voltage of transistor 52, transistor 52 becomes saturated causing the voltage at collector 58 to approach ground. This change in voltage of transistor collector 58 has a fixed phase relation to the power line voltage waveform via the step-down transformer 38.

The transistor collector 58 is connected through a resistor 64 to a source of supply voltage $V_c$. A microcontroller generally designated by the numeral 66 is also connected to supply voltage $V_c$. The microcontroller 66 monitors the voltage of transistor collector 58 for the transition in voltage from $V_c$ to the saturation voltage of transistor 52 in order to synchronize the operation of the power control relay 46 to the power line waveform. While $V_s$ is greater than the actuation voltage of clamping diode 60, diode 60 is normally maintained nonconductive. While $V_s$ is greater than the actuation voltage of transistor emitter 56, current flows in a positive direction through resistor 50 in conductor 48. The transistor collector 58 is connected by conductor 68 to input terminal 70 of microcontroller 66. Microcontroller 66 includes an output terminal 72 and a feedback input terminal 74 and is connected to ground 76.

The output terminal 72 of microcontroller 66 is connected by conductor 78 through resistor 80 to a transistor 82 having a base 84, emitter 86 connected to ground 88 and a collector 90. When microcontroller 66 applies supply voltage $V_c$ to output terminal 72 by its internal drive circuitry, voltage $V_c$ is greater than the voltage for actuation of transistor 82 which is normally maintained nonconductive. Positive current flows through resistor 80 and conductor 78 to base 84 of transistor 82. This results in transistor 82 entering its saturation region. At saturation transistor 82 applies current from collector 90 through conductor 92 to diode 94 which is connected across coil 96 of relay 46. In this instance diode 94 is reverse biased and current flows through coil 96. Current through coil 96 generates a magnetic field resulting in closure of the contacts of relay 46.

As shown in the embodiment of the synchronization circuit 10 in FIG. 2, the control relay 46 includes a first contact pair 98 connected to the load 44 and a second contact pair 100 connected to ground 102. The contact pairs 98 and 100 are associated in the structure of the relay 46 in such a manner that each pair 98, 100 closes in a preselected time relationship to each other. When the microcontroller 66 connects output terminal 72 to ground, current flow to resistor 80 and transistor 82 is interrupted. Consequently transistor 82 is normally maintained nonconductive.

In the nonconductive state of transistor 82 insufficient current flows through relay coil 96. As a result the magnetic field produced by the coil 96 is reduced to a magnitude below a magnitude necessary to maintain closure of the contact pairs 98 and 100. Therefore the contact pairs 98 and 100 are normally maintained in an open position as shown in FIG. 2. As transistor 82 initially enters a nonconductive state of operation, the diode 94 dampens out stored current in coil 96 to protect the transistor 82 from potentially damaging voltage surges.

Figure 1A:
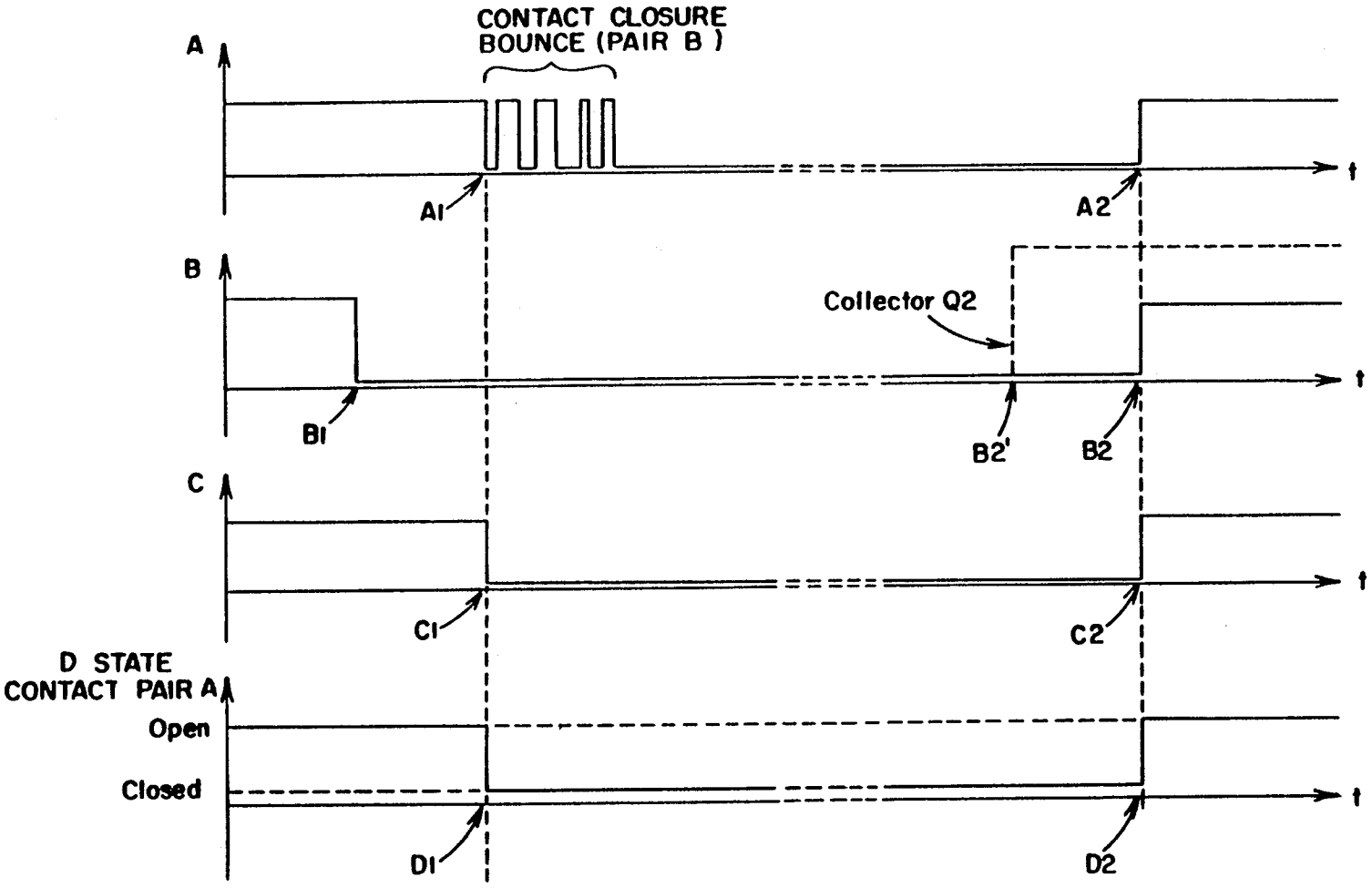
FIG. 1A is a graphic illustration of the operation of controlling the opening and closing of the contacts at a preselected point in the power line waveform.

Further in accordance with the present invention the synchronization circuit 10, shown FIG. 2, filters out the effects of relay contact bounce when the respective relay contacts 100 close. Consequently by filtering out the contact bounce from the operation of the electromechanical relay 46, the circuitry 10 detects first closure of the relay contacts 100 which remain closed on first closure. No subsequent bounce induced opening and closing of the contacts is detected by microcontroller 66, as diagrammatically illustrated in FIG. 1A at point Al for waveform A. Waveform C in FIG. 1A is illustrative of the operation of the synchronization circuit 10 where the voltage at point Cl goes low upon the first high to low transition in comparison with point Al in waveform A. Further as shown in waveform C at all succeeding bounce pulse signals at level C remain below the logic low input threshold of the microcontroller 66 shown in FIG. 2.

Referring to waveform B, during the time interval prior to point B1 the contacts 98 as shown in FIG. 2 are opened and the transistor 82 is nonconductive. Point B in the circuit is then pulled high by the voltage supplied through the series combination of resistor 106 and the relay coil 96. The voltage at point B of FIG. 2 in the feedback circuit 104 is clamped by diode 116 to the supply voltage plus the actuation voltage of diode 116. Diode 116 is connected to a transistor 118 having a base 120, collector 122, and emitter 124. The transistor base 120 is connected through resistor 126 to diode 128. Diode 128 is in turn connected through resistor 130 to transistor 132 having base 134, emitter 136, and collector 138. The collector 138 is connected to ground 140 and through capacitor 142 and resistor 144 to supply voltage $V_c$.

The closed loop feedback circuit 104 provides a feedback signal through conductor 146 to the input terminal 74 of the microcontroller 66. With this arrangement the voltage at point C in FIG. 2 is held to the voltage $V_c$ by resistor 144 and the transistor 118. The maximum voltage which the transistor 118 can charge the capacitor 142 is the voltage $V_c$ since the voltage at transistor emitter 124 can only rise to the voltage which is the difference between the voltage at point B and the voltage applied to transistor emitter 124. Thus the voltage at point C is equal to the supply voltage $V_c$ plus the voltage applied to diode 116 less the voltage applied to the emitter 124 of transistor 118. The voltage drop across resistor 126 is negligible when the voltage at point C is equal to the supply voltage $V_c$. Resistor 114 and diode 128 hold the base 134 of transistor 132 at a high voltage through the resistor 130. In this manner the transistor 132 is maintained in a nonconductive or in a "cut-off" region.

Again referring to FIG. 1A, at point B1 and before point A1 the transistor 82 becomes saturated and through resistor 106 actuates diode 116 and diode 128 and the base-emitter junction of transistor 118 through resistor 126 to become reverse biased. At this point the relay contacts 98 and 100 are not closed, and point A will be high due to current flowing through resistor 114. In this manner transistor 132 is maintained nonconductive. The voltage at point C is maintained at supply voltage $V_c$ by current flow through resistor 144.

At point A1 of waveform A, shown in FIG. 1A, the first closure of the contact pair 100 occurs. When the contacts 100 close, transistor 132 is switched to a conductive state through the base connection with resistor 130 resulting in rapid discharge of capacitor 142 by operation of transistor 132. When the contacts 100 bounce open the transistor 132 is once again switched to nonconductive state due to the reverse bias applied to the base-emitter junction of transistor 132.

Preferably the capacitor 142 and the resistor 144 are chosen with a charging time constant which is much larger than the longest high bounce time. As a result the voltage level at point C can be maintained below the logic low threshold of microcontroller 66. Consequently when the relay contacts 100 settle to a fully closed position, the transistor 132 remains conductive to maintain the voltage at point C below the logic low threshold of microcontroller 66.

When transistor 82 is switched from a conductive state to a nonconductive state, as represented by point B2' in FIG. 1A, the collector 90 of transistor 82 is switched high through coil 96. Voltage at point C held at the actuation voltage of transistor 132 long as contact pair 100 is closed. When contact pair 100 opens the voltage at point A is pulled high by the diode 128 and the resistor 114. At this point the transistor 132 is switched to operation in its "cutoff" region. At the same time the voltage at point B rises and is clamped to a voltage that is the summation of supply voltage $V_c$ and the actuation voltage of diode 116. With the voltage at point B high, transistor 118 is switched to a conductive state through resistor 126 connected to base 120. As a result transistor 118 rapidly charges capacitor 142 to the value of the supply voltage $V_c$.

Thus in accordance with the present invention, the microcontroller 66 monitors the voltage applied to point C to determine when the relay 46 opens and closes. The voltage at point C changes from high to low corresponding to operation of the contacts 98 and 100. The voltage at point C changes from high to low corresponding to the first closure of the contacts 98 and 100.

Figure 3:
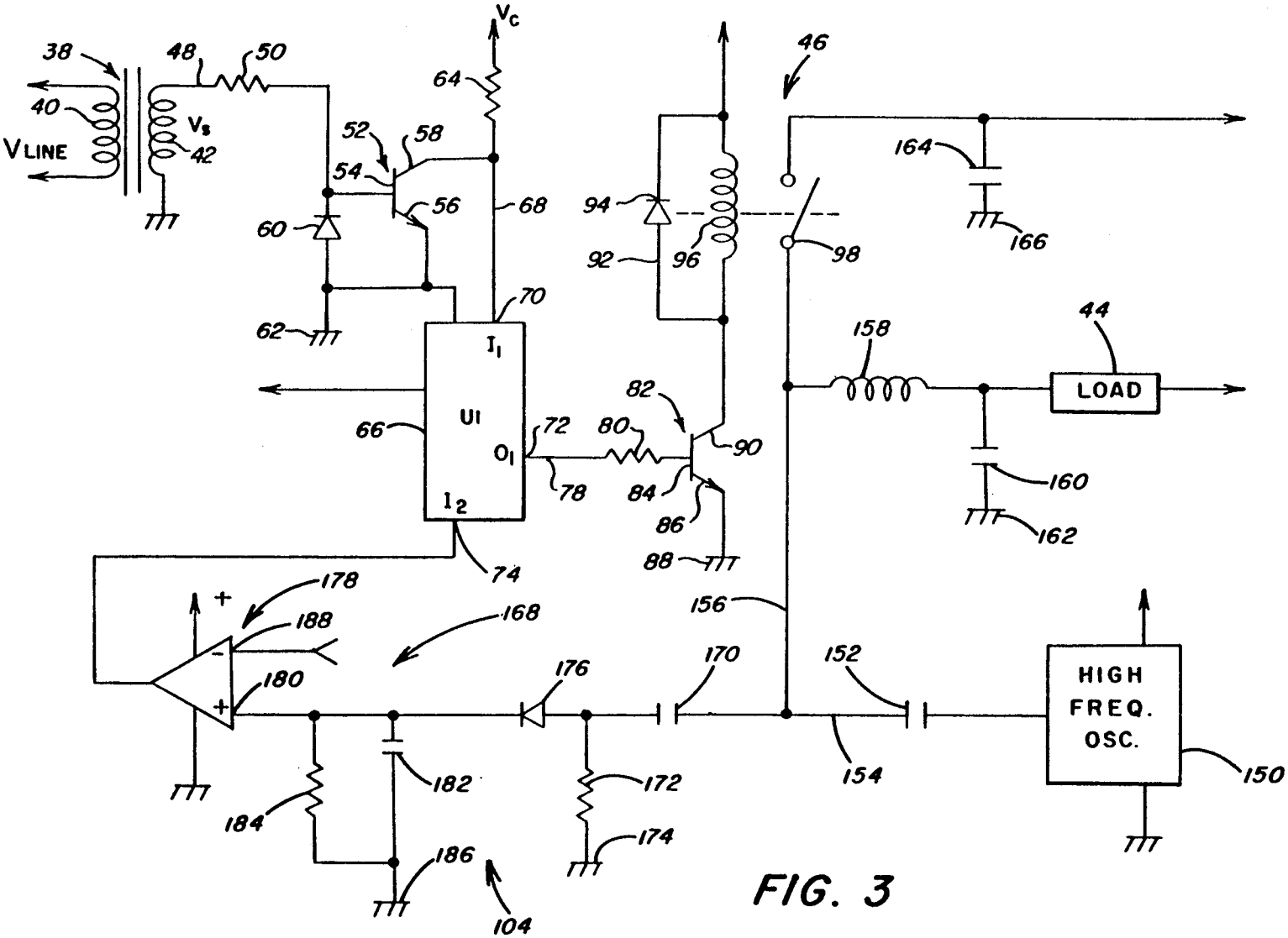
FIG. 3 is a schematic of another embodiment of control circuitry for maintaining synchronization of the operation of an electromechanical relay with the power line waveform.

Now referring to FIG. 3, there is illustrated another embodiment of the present invention by which contact closure feedback to the microcontroller 66 utilizes a high frequency signal coupled to the power line. With this arrangement a high frequency signal is capacitively coupled to the power line near the relay contacts. The high frequency signal is superimposed on top of the power line waveform. When the relay contacts are closed, the amplitude of the superimposed signal will be different from the amplitude of the signal when the relay contacts are open.

A sensing network is connected to the relay contacts to measure variations in the amplitude of the superimposed signal. The microcontroller 66 is used to measure the "pull-in" time of the relay by determining the length of time between actuation of the relay coil 96 and the corresponding transition in the output of the sensing network. Consequently the microcontroller 66 provides the delay necessary to cause the relay contacts to close at the desired point in the line voltage waveform with respect to the voltage zero crossing of the waveform. For purposes of convenience, like numerals referred to in FIG. 3 designate to like parts discussed above and shown in FIG. 2.

The feedback loop 104 incorporates a high frequency signal coupled onto the low frequency power signal to detect when the relay contacts 98 open or close. For this operation a high frequency oscillator 150 is coupled onto the low frequency power line signal to detect when the relay contacts close or open. The output of oscillator 150 is connected through capacitor 152 and conductor 154 to conductor 156. The output from oscillator 150 operates at a frequency which is many times greater than the power line frequency. As a result a high frequency is superimposed onto the power line. The value of the capacitor 152 is selected so as to act as a high pass filter to conduct the high frequency detection signal and block the low frequency power line waveform from entering the circuitry of the oscillator 150.

When the contacts 98 are open the high frequency signal will detect an impedance higher than that when the contacts are closed. As shown in FIG. 3, an inductor 158 is connected to conductor 156 and through capacitor 160 to ground 162. The inductor 158 is also connected to the load 44. The inductor 158 provides a high impedance for the sense signal and together with the capacitor 160 which acts as a low pass filter prevents the sense signal from causing conductive high frequency interference on the power line outside of the controlled load 44. When the contacts 98 are closed capacitor 164 connected to ground 166 acts as a low pass filter to "short" the high frequency sense signal to ground 166. With the signal "shorted" to ground, the peak to peak amplitude of the sense signal is reduced from the open contact condition.

The peak amplitude of the high frequency sense signal is detected by a peak detection circuit generally designated by the numeral 168 in FIG. 3 which is connected through capacitor 170 to conductor 156 and the high frequency oscillator 150. The capacitor 170 is connected through resistor 172 to ground 174 and diode 176. Diode 176 is connected to a comparitor 178 at input terminal 180. Capacitor 182 and resistor 184 connected to ground 186 positioned in parallel between diode 176 and amplifier input terminal 180.

The values of capacitors 152 and 170 are selected so as to function as a high pass filter to pas the high frequency sense signal and block out the low frequency power line waveform. The amplitude of the high frequency voltage across resistor 172 approximates the amplitude of the sense signal coupled onto the power line at contacts 98. When the contacts 98 are open, the peak to peak amplitude at resistor 172 will be higher than when the contacts 98 are closed.

Capacitor 182 is charged through diode 176 to a voltage level approximately 0.7 volts below the peak voltage across resistor 172 when the voltage across resistor 172 is at maximum. As the voltage across resistor 172 drops, diode 176 becomes reverse biased imposing the peak voltage of resistor 172 on capacitor 182. The voltage level on capacitor 182 is compared to a reference level by comparator 178. When the voltage on capacitor 182 is higher than the voltage $V_r$ applied to comparator input terminal 188, the output of comparator 178 is high. On the other hand, when the voltage on capacitor 182 is lower than the input voltage applied to terminal 188, the output of the comparator 178 is low.

The resistor 184 discharges the capacitor 182 when the peak voltage across resistor 172 suddenly drops which is when the contacts 98 close. The value of the resistor 184 is chosen so that the time constant is sufficiently fast to enable a rapid circuit response to closure of the relay contacts 98. Closure of the relay contacts 98 is signified by a high to low transition at the output of the comparator 178 which serves as input to the microcontroller 66 at terminal 74. Opening of the relay contacts 98 is signified by a high to low transition of the output from the comparator 178.

Figure 4:
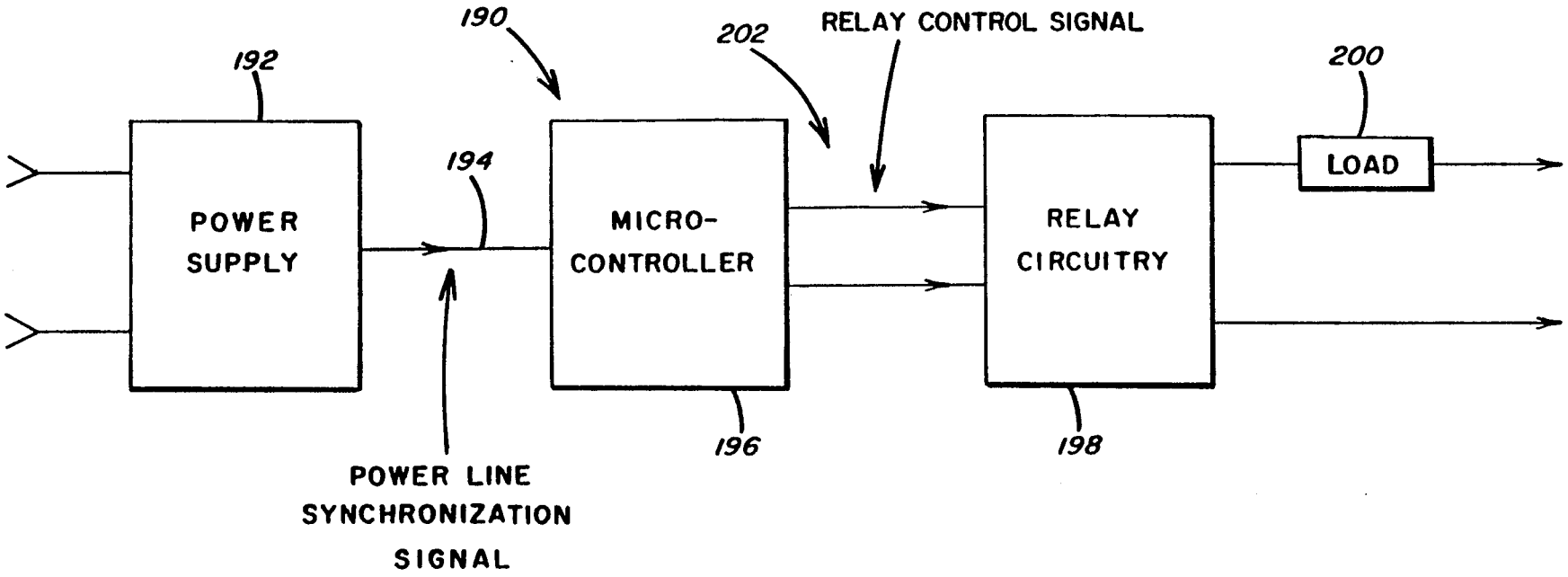
FIG. 4 is a diagrammatic illustration of electrical apparatus for opening and closing contacts of an electromechanical relay at a desired point in the power line waveform.
Figure 5:
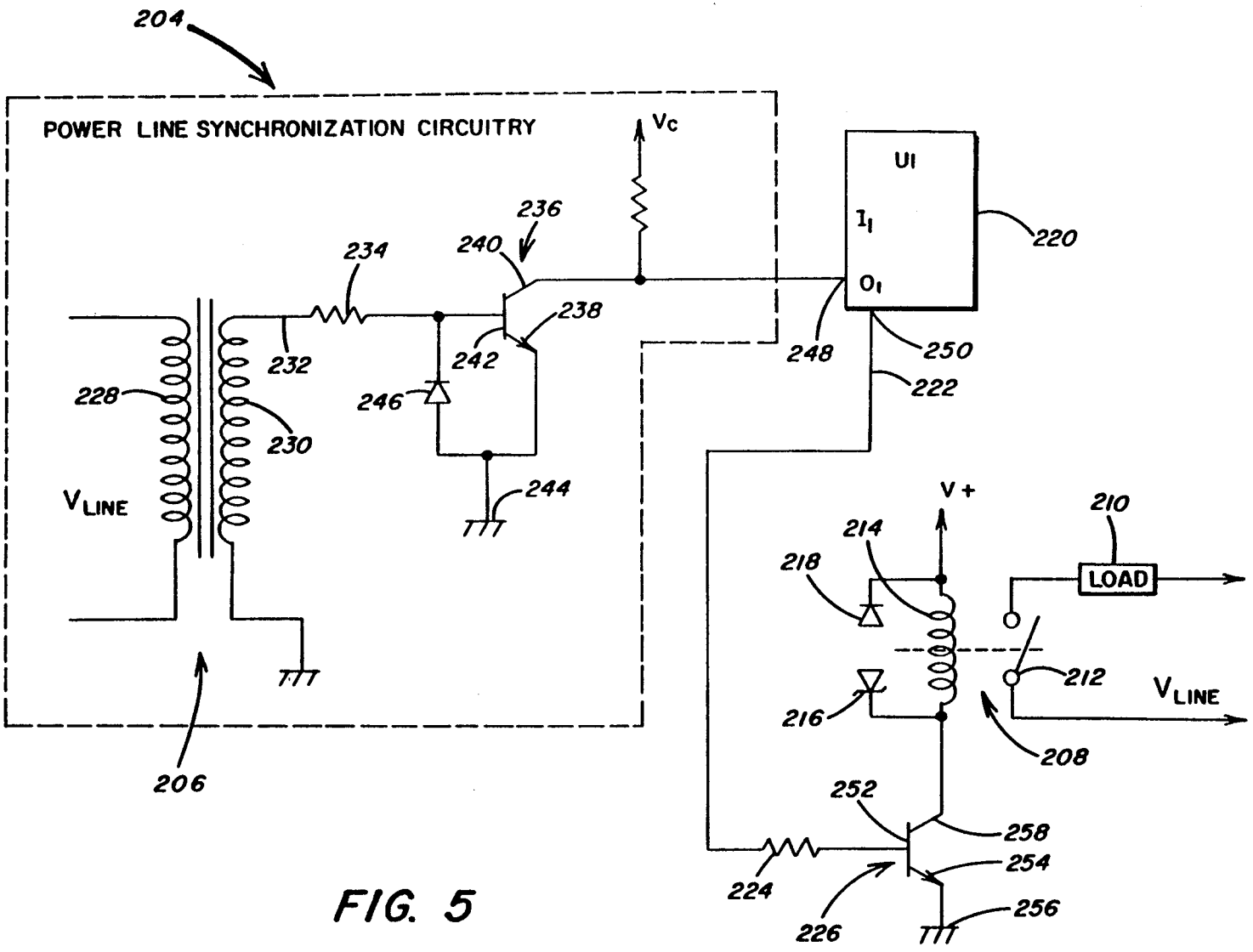
FIG. 5 is a schematic illustration of the circuit corresponding to the diagram shown in FIG. 4 for setting the time in which an electromechanical relay is opened and closed.

The present invention as illustrated in FIGS. 4 and 5 is further directed to a method for minimizing the transfer of material from the relay contacts as a result of the relay breaking an A.C. load current. When a load current is interrupted, the amount and direction of material transfer is affected by the load current at the contact separation, the duration of electrical arc, and the polarity of the relay contacts. The material transfer is induced by the $I^2R$ heating during breaking. As a result, the contact material is transferred from the anode contact to the cathode contact. Also, during the breaking of the load circuit, the electrical arc causes material transfer from the cathode contact to the anode contact. Thus, by controlling the maximum breaking current, the arc duration, and the polarity of the contacts during breaking, contact material transfer is greatly reduced, which in turn, extends the life expectancy of the electromechanical relay.

Now referring to FIG. 4, there is illustrated a relay synchronization circuit generally designated by the numeral 190 that includes a power supply 192 connected by a conductor 194 which supplies a synchronization signal to a microcontroller 196. The microcontroller 196 controls operation of relay circuitry 198 that controls the supply of power to a load 200. The power supply 192 includes a control board, which in addition to supplying the necessary operating voltage potentials to the circuit 190, provides a signal through the conductor 194 to the microcontroller 196 or equivalent controlling circuitry that generates a signal which indicates the occurrence of a specific point in the line voltage waveform. Generally, the current load waveform has a defined relationship to the line voltage.

The signal related to the line voltage indicates a specific point on the load current waveform. In the alternative to sensing a point on the line voltage waveform, the actual current waveform flowing through the relay circuitry 198 can be detected. A feedback signal is sent from the relay circuitry 198 to the microcontroller 196 as input representing the occurrence of a specific point in the load current waveform or load current information to be used for controlling the operation of the relay circuitry 198. The feedback signal from the relay circuitry 198 sets the drop-out point of the relay contacts. The feedback signals are thus used to provide the necessary synchronization of the circuit 190 to the relay contact current waveform.

By using the defined synchronization point, the circuit 190 provides the appropriate time delay to assure that the contacts of the relay circuitry 198 will open at or closely as possible before the zero voltage cross point in the contact current waveform. By breaking the contact current at or before the zero cross point, the contact breaking current and the arc duration are minimized. This has the affect of minimizing the amount of material that is transferred between the contacts of the relay.

In addition, by using the synchronization point, the controlling circuit 190 permits the relay contacts to alternate between opening on the positive half cycle and the negative half cycle of the load current waveform. Alternating between the positive and negative half cycles results in transfer of material back and forth between the contacts. In this manner, the net amount of material transferred from one contact to the other is maintained negligible over a large number of duty cycles of the relay circuitry 198.

Preferably in accordance with the present invention as illustrated in FIG. 4, a feedback control circuit generally designated by the numeral 202 is utilized to control the relay circuitry 198 so that the contacts thereof open at the desired point in the line current waveform. The details of the feedback control circuit 202 ar illustrated in FIGS. 2 and 3 discussed hereinabove. Thus, by synchronizing the drop-out of the relay circuitry 198 with a line current waveform, the relay contacts break the load current at the minimum amplitude to minimize $I^2R$ heating. Breaking the current at or very nearly before the zero cross point, minimizes destructive electrical arcing. Further, by breaking the current load and alternating polarity minimizes the net material transfer over a large number of operations of the relay circuitry 198.

Now referring to FIG. 5, there is illustrated a power line synchronization circuit generally designated by the numeral 204 for synchronizing the A.C. current waveform supplied by a power source (not shown) through a step-down transformer 206 with the operation of a relay generally designated by the numeral 208 for controlling a load 210. The electromechanical relay 208 is initially characterized to determine a drop-out timing operating range. The electromechanical relay 208 includes a pair of contacts 212 and a coil 214. A zener diode 216 in series with a diode 218 across coil 214 is used for coil damping to narrow the drop out timing distribution to a preferred variation.

A microcontroller 220 is connected by conductor 222 through resistor 224 and transistor 226 to the electromechanical relay 208. The microcontroller 220 is programmed to delay a fixed time period following the negative edge of the power line synchronization circuit output signal before turning off the current to the relay 208. The delay is set so that the relay 208 with the longest drop-out time will have the contacts 212 open just prior to the load current crossing the zero point of the current waveform. Given this turn off delay and the known characteristics of the relay 208, the relay contacts 212 will open shortly before the load current zero crossing point is reached.

Power is supplied from a source through the step-down transformer 206 that includes a primary coil 228 and a secondary coil 230. The power supplied to the transformer 206 corresponds to the power supplied to the load 210 or has a known phase relationship to the power line connected to the controlled load 210. Due to the operational characteristics of the transformer 206, the voltage present at the secondary coil 230 will be proportional in amplitude and have a fixed phase relationship to the voltage waveform supplied to the primary coil 228.

The secondary coil 230 is connected by conductor 232 through resistor 234 to a transistor 236. The transistor 236 includes an emitter 238, a collector 240 and a base 242. The emitter 238 is connected to ground 244 and diode 246 is connected to the transistor base 242. When the secondary voltage of the transformer 206 is more negative than the turn-on voltage of transistor 236, the base-emitter clamping diode 246 is forward biased. Current flows through resistor 234 in a negative direction, and transistor 236 is maintained in a nonconductive state. With the transistor 236 in a nonconductive state, the voltage level at collector 240 is approximately at supply voltage $V_c$. As the voltage from the transformer 206 increases to a level greater than the turn-on voltage of transistor 236, the transistor 236 will become saturated causing the voltage level present at the collector 240 to change from $V_c$ to the saturation voltage of transistor 236. This transition of the collector voltage will have a fixed phase relationship to the line voltage waveform via the step-down transformer 206.

The microcontroller 220 monitors the voltage of the transistor collector 240 for the transition in the change in magnitude of the voltage from $V_c$ to the saturation voltage of the transistor 236, in order to synchronize operation of the power control relay 208 to the power line waveform. When the voltage of the transformer secondary coil 230 is greater than the turn-on voltage of diode 246, the diode 246 remains nonconductive. While the voltage of the secondary coil 230 is greater than the turn-on voltage of the base-emitter junction of transistor 236, current flows in a positive direction through resistor 234.

The microcontroller 220 includes an input terminal 248 and an output terminal 250. The output terminal 250 is connected by conductor 222 to resistor 224. The resistor 224 is, in turn, connected to base 252 of transistor 226. Emitter 254 of transistor 226 is connected to ground 256. Collector 258 of transistor 226 is connected to coil 214 of the relay 208. Further, the microcontroller 220 is connected to the ground corresponding to the grounded connection of transistor emitter 254.

With this arrangement, when microcontroller 220 connects with output terminal 250 o supply voltage $V_c$ through the internal drive circuitry of microcontroller 220 and the voltage $V_c$ is greater than the turn on voltage of transistor 226, positive current flows through resistor 224 to transistor base 252. As a result, transistor 226 becomes saturated, and when in such a state of operation, diode 218 is reverse biased. When diode 218 is reverse biased, no current flows through zener diode 216, and current flows through coil 214 of relay 208. Current flow in this manner generates a magnetic field around relay coil 214 which actuates closure of the relay contacts 212.

When the microcontroller 220 connects output terminal 250 to ground via the internal drive circuitry of microcontroller 220, current ceases to flow through resistor 224. As a result, transistor 226 is switched from a conductive state to a nonconductive state. The inductively stored current in the coil 214 consequently flows through the coil damping network formed by the combination of diode 218 and zener diode 216. Diode 218 and zener diode 216 dissipate stored energy in the relay coil 214 as heat. The larger the voltage drop across the damping network, the more rapid the dissipation of the energy of coil 214. When the energy in coil 214 is dissipated, the current in the coil 214 ceases. Consequently, the magnetic field holding the contacts 212 in a closed position terminates. The contacts 212 then switch to their normally open position as shown in FIG. 5. By using the zener diode 216 to increase the rate at which the magnetic field of coil 214 collapses, the distribution in the drop-out timing becomes narrower.

According to the provisions of the patent statutes, we have explained the principle preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. Power line synchronization circuitry comprising:

an electrical power supply, an electrical load for receiving current from a power line at a preselected interval in the power line waveform, a relay positioned between said power supply and said load, said relay including a pair of contacts being movable upon actuation between an open position and a closed position to interrupt and supply power to said load, respectively, control means for controlling the supply of voltage and current from said power supply to said relay to actuate said relay at a selected interval in the power line waveform so that voltage and current are supplied to and removed from said load just prior to the period of time in the power line waveform when the applied voltage and current is zero, comparator means for sensing actuation of said relay with respect to the time int he power line waveform when said relay is actuated and transmitting a responsive signal to said control means, said comparator means transmitting a responsive signal to said control means in the event said contacts open or close, said control means being responsive to the signal from said comparator means to adjust the supply of voltage and current to said relay to maintain opening and closing of said relay synchronized with a selected interval in the power line waveform and thereby measure the time for actuation of the relay to adjust actuation thereof such that the contacts open and close at the desired point in the power line waveform with respect to the point in the load power line waveform when the voltage and current is zero, means for superimposing a high frequency signal on top of the power line waveform, sensing means connected to said relay contacts for receiving said high frequency signal, said relay upon actuation supplying said sensing means with a signal from the power line, said sensing means upon actuation of said relay coupling the high frequency signal and the power line signal to generate an output signal to said control means, and said control means including a microcontroller for measuring the length of time between the actuation of said relay and receipt of the output signal from said sensing means.

2. Power line synchronization circuitry as set forth in claim 1 in which, said means for superimposing a high frequency signal on top of the power line waveform includes as oscillator circuit capacitively coupled to said electrical power supply, and said oscillator circuit having an operating frequency greater than the frequency associated with said electrical power supply.

3. Power line synchronization circuitry as set forth in claim 1 which includes, filter means for conducting the high frequency signal to said oscillator circuit and preventing conduction of the low frequency signal associated with the power line waveform to said oscillator circuit.

* * * * *